US005232382A

United States Patent [19]

Karlovich

[11] Patent Number: 5,232,382

[45] Date of Patent: Aug. 3, 1993

[54] PGA SOCKET CONTACT

[75] Inventor: Robert J. Karlovich, Los Gatos, Calif.

[73] Assignee: Foxconn International, Inc., Sunnyvale, Calif.

[21] Appl. No.: 937,517

[22] Filed: Aug. 28, 1992

[51] Int. Cl.[5] ..... H01R 13/187

[52] U.S. Cl. ..... 439/843; 439/380

[58] Field of Search ..... 439/81, 82, 380, 381, 439/842–850, 856, 857, 861, 851

[56] References Cited

U.S. PATENT DOCUMENTS 3,218,606 11/1965 Schultz ..... 439/82
3,539,965 11/1970 Morehart et al. ..... 439/81
3,704,441 11/1972 Douglas ..... 439/843

FOREIGN PATENT DOCUMENTS 0285273 12/1990 Fed. Rep. of Germany ..... 439/842
1388666 1/1965 France ..... 439/851

*Primary Examiner*—David L. Pirlot

[57] ABSTRACT

An electrical socket contact (1) includes an elongated sleeve (30) having an upper large hollow portion (32) for receiving a clip (10) therein and a lower small pin portion (34) for reception in a hole of a board on which a PGA insulative socket housing is mounted. The clip (10) comprises at the top a ring (12) from which a pair of opposite beams (16) extend downwardly. The beams (16) converge approximately in the midst for engagement with a male pin received within the socket contact (1). A bight portion (20) connectively intermediates between the distal ends of the beams (16) to serve to stabilize the beams (16) and allow the beams (16) to move as a unit. At the top, the ring (12) retains the clip within the sleeve (30) with an interference fit and at the bottom, the bight portion (20) associated with the distal ends of the beams (16) freely move in all directions to accommodate any off-center of the male pine due to angularity or position.

10 Claims, 5 Drawing Sheets

PGA SOCKET CONTACT

BACKGROUND OF THE INVENTION

1. Field of the Invention

The present invention relates to socket type contacts for use with an insulative housing which solders to a printed circuit board and can accept a pin grid array (PGA) having a plurality of pins.

2. Description of the Prior Art

The contacts used in the PGA socket housing includes two types of which one is of a single tubular socket integrally having a plurality of punched-out or sheared-off independent fingers (generally three) extending inwardly to electrically and mechanically engage a corresponding pin received therein for connection, for example, U.S. Pat. Nos. 4,934,967 and 4,707,052. The other type has a tubular socket incorporating therein a separate clip or insert having a ring portion at the top to locate and hold the clip within the socket, and having a plurality of cantilever beams extending downwardly therefrom and converging toward each other for engagement with an inserted corresponding pin by their distal free ends, for example, U.S. Pat. Nos. 4,186,990, 4,236,776, 4,296,993, 4,415,212, 4,470,649, 4,534,603, 4,784,662, 4,822,288 and 4,981,450.

Regardless of either type, a disadvantage of the prior art contacts is that each finger or cantilever beam is separated from each other so when a lead pin from a PGA package is inserted into the socket contact of either type, the amount of deflection for each leg will vary greatly, depending on the angle and position of entry. Some legs may even individually experience a torsional twist, rather than a linear deflection because of the off-center entry of the lead pin. Consequently, the insertion force, which is a function of the normal force exerted on the PGA lead pins, which is a function of the amount and type of deflection of each finger or cantilever beam, will be higher then a more forgiving design. Accordingly, one solution for this problem is to properly combine the free ends of these cantilever beams together so the fingers are moved as a unit when the PGA lead pin is off-center due to angularity or position. Thus, the deflection of the cantilever beams is more uniform and linear than with the other designs. Therefore, the total insertion force of the PGA package into the insulative housing can be reduced with this design.

SUMMARY OF THE INVENTION

In accordance with the present invention, an electrical socket contact includes an elongated sleeve having an upper large hollow portion for receiving a clip therein and a lower small pin portion for reception in a hole of the board on which a PGA insulative socket housing is mounted. The clip comprises at the top a ring from which a pair of opposite beams extend downwardly. The beams converge approximately in the midst for engagement with a male pin received within the socket contact. A bight portion connectively intermediates between the distal ends of the beams to serve to stabilize the beams and allow the beams to move as a unit. At the top, the ring retains the clip within the hollow portion of the sleeve with an interference fit, and at the bottom, the bight portion associated with the distal ends of the beams freely moves in any direction to accommodate any off-center of the male pin due to angularity or position.

The socket contact according to the invention is characterized in that the clip can be formed by stamping a metal sheet and successively bending to define the ring at the top, the bight portion at the bottom, and the convergence at the middle.

DETAILED DESCRIPTION OF THE PREFERRED EMBODIMENT

References will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Figure 1:
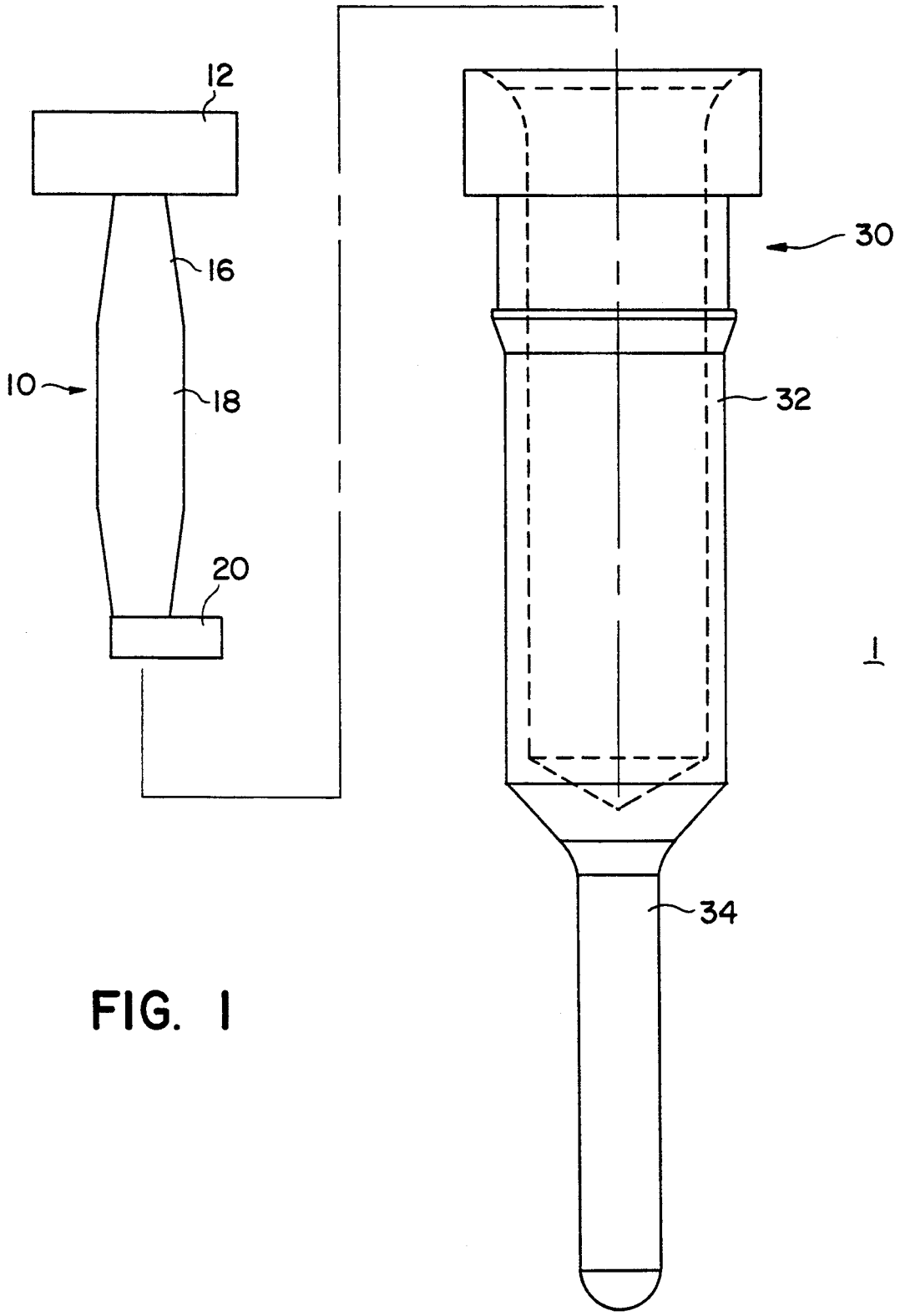
FIG. 1 is a front elevational view of an electrical socket for use with a PGA insulative socket housing in accordance with the present invention.
Figure 2:
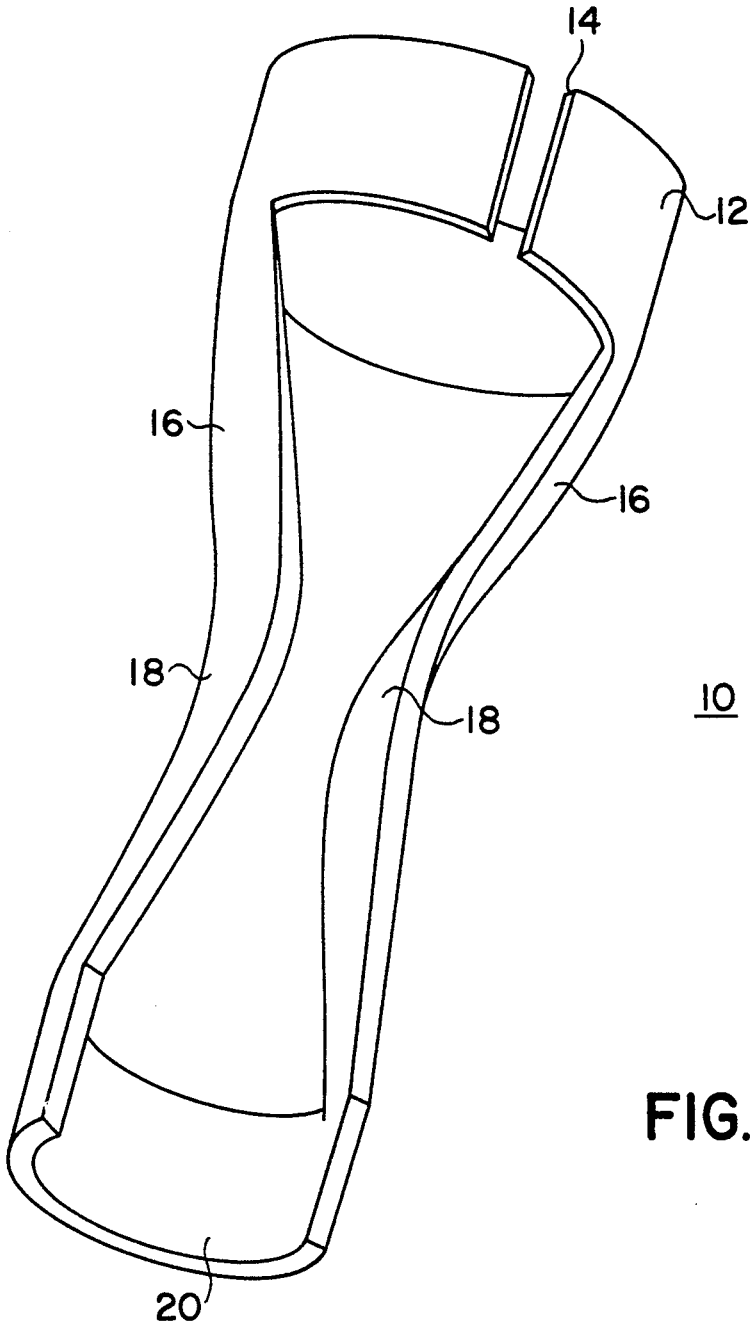
FIG. 2 is a perspective view of a clip of FIG. 1.

It will be noted here that for a better understanding, like components are designated by like reference numerals throughout the various figures. Attention is now directed to FIG. 1 showing a clip or insert 10 used in a sleeve 30 of the socket contact 1 which is similar to the sleeve used in the second type prior art. Also referring to FIG. 2, a generally circular ring or cylindrical band portion 12 is horizontally provided at the top of the clip 10 and defines an axial seam 14 thereof. A pair of diametrically opposite beams 16 extend downwardly from the ring 12, initially angling toward each other in their upper half portions, and successively angling away from each other in their lower half portions, thereby forming a convergency portion 18 medianly thereof. The beams 16 are widened in the convergency portion 18 to ensure the PGA lead pin is contacted across its diameter instead of a shorter chord length. Horizontally formed at the bottom o the clip 10 is a bight portion 20 having a generally semicircular shape of which the opposite ends are integrally and laterally connected to the distal ends of the beams 16, respectively. The ends of the bight portion 20 are flush with the side surfaces of the corresponding beams 16, respectively.

Figure 3A:
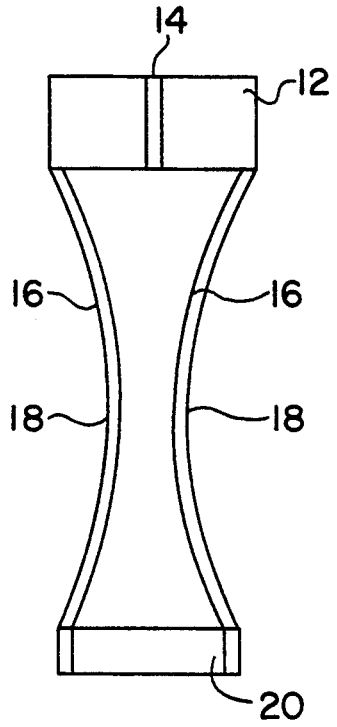
FIG. 3(A) is a front elevational view of the clip of FIG. 2.
Figure 3C:
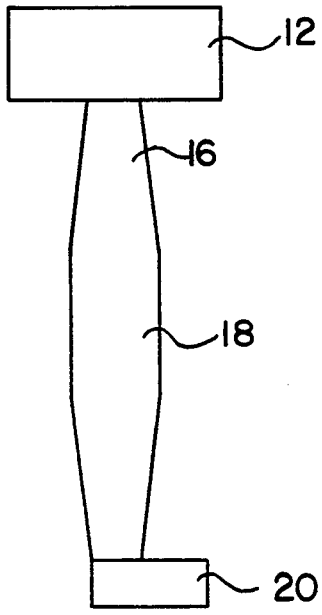
FIG. 3(C) is a side elevational view of the clip of FIG. 2.
Figure 3B:
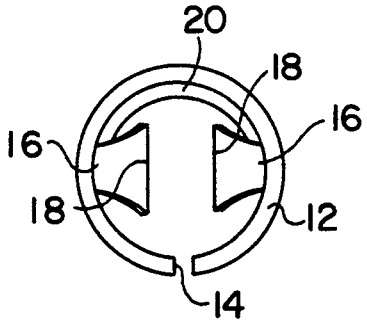
FIG. 3(B) is a top elevational view of the clip of FIG. 2.

It can been seen that the beams 16 are converged to each other proximately at their midlength as shown in FIGS. 3(A) and 3(B), and also have the wider sections thereabout as shown in FIGS. 3(B) and 3(C). In FIGS. 3(B) and 3(C), it can been noted that the diameter of the bight portion 20 is smaller than the diameter of the ring 12 for the purpose of free movement within the sleeve 30.

Referring back to FIG. 1, the sleeve 30 which is positioned within a cavity of a PGA insulative socket housing (not shown), comprises an upper large hollow portion 32 for receiving the clip 10 therein to accommodate a corresponding PGA lead pin inserted therein, and a lower small pin portion 34 for reception in a hole of a board (not shown) on which the PGA insulative socket housing is mounted. It can be understood that the outer diameter of the ring 12 is larger than the inner diameter of the hollow portion 32 of the sleeve 30 and the outer diameter of the bight portion 20 is smaller than the inner diameter of the hollow portion 32 of the sleeve 30, so that when the clip 10 is inserted into the hollow portion 32 of the sleeve 30, the ring 12 can retain the clip 10 therein for the sake of circumferential interference engagement with the inner surface of the hollow portion 32 of the sleeve 30 and the bight 20 can freely move therein due to the sufficient clearance therebetween.

It can be appreciated that the seam 14 of the ring 12 can provide a resilience therewith for facilitating engagement with the hollow portion 32 of the sleeve 30.

It can also be contemplated that the distal ends of the beams 16 are joined by the bight portion 20 which is radially moveable within the hollow portion 32 of the sleeve 30 thereby serving to stabilize the beams 16 and allow the beams 16 to move as a unit to forgive PGA lead pin misalignment due to off-center entry.

It can be noted that the bight portion 20 has generally a shape of semicircle which may provide a lateral open room for accommodating the misalignment of a longer PGA lead pin.

The sleeve 30 used in this embodiment is of the standard component which can be bought in the current market. The clip 10 used in the embodiment can be stamped from a flat blank with the following rolling and forming. In other words, the clip 10 is made of one piece metal.

Figure 4A:
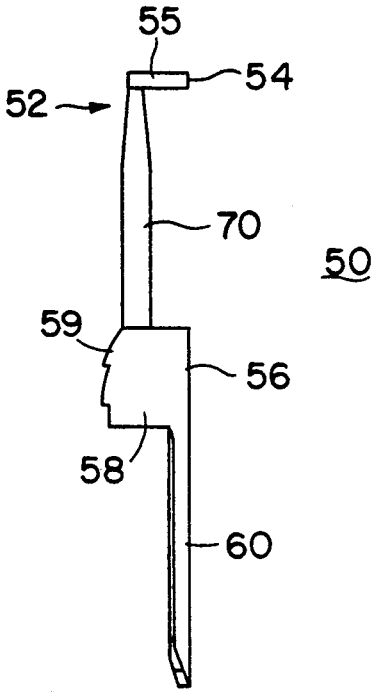
FIG. 4(A) is a front elevational view of a socket contact of another embodiment in accordance with the present invention.
Figure 4B:
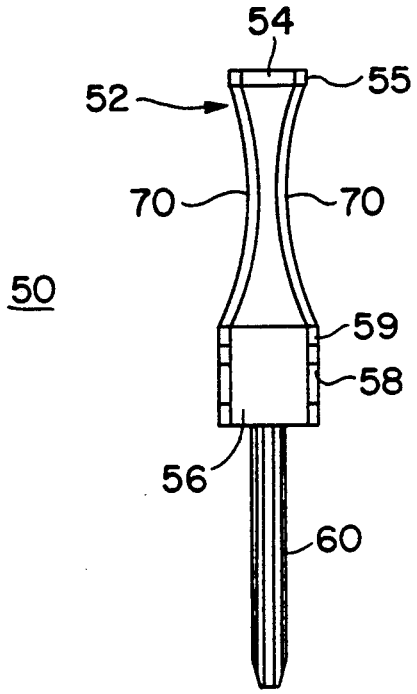
FIG. 4(B) is a side elevational view of the socket contact of FIG. 4(A).
Figure 4C:
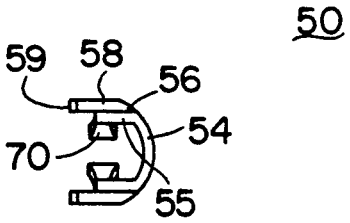
FIG. 4(C) is a top elevational view of the socket contact of FIG. 4(A).

FIGS. 4(A)–4(C) shows another embodiment of the present invention which relates to the first type prior art. The socket contact 50 includes an upper contact portion 52 for receiving a corresponding PGA lead pin therein and a lower pin portion 60 extending downwardly from the contact portion 52 for reception in a hole of a board (not shown) on which the PGA socket contact and its associated insulative housing 80, as shown in FIG. 5, are seated. The upper contact portion 52 comprises an upper small U-shaped section 54 lying at the top, a lower large U-shaped section 56 facing in the same direction with the small U-shaped section 54 and lying at the bottom wherein a bottom portion of each U-shaped section is disposed in alignment with the pin portion 60 of the socket contact 50, and a pair of generally parallel beams 70 intermediating therebetween. In this manner, the pin portion 60 laterally and downwardly extends from the bottom portion of the large U-shaped section 56. Similar to the beams 16 disclosed in the first embodiment, the beams 70 are bowed to each other with their closest points approximately at midway between the two U-shaped sections 54 and 56. Each beam 70 has a reduced dimension at its distal end where the small U-shaped section 54 is connected in order to reduce the flexible strength of the beam 70 so that the insertion force may be reduced.

Plural barbs 59 are positioned on the top surface of each leg 58 of the large U-shaped section 56 for engagement with the associated housing which will be described later. For enhancement of resilience of the upper contact portion 52 of the socket contact 50, the beams 70 are connected to the top portions of legs 58 of the large U-shaped section 56 and of the corresponding legs 55 of the small U-shaped section 54, respectively so that the beams 70 have significant resilience for lowering the insertion force due to the beams being supported by two resilient U-shaped sections 54 and 56.

Figure 5A:
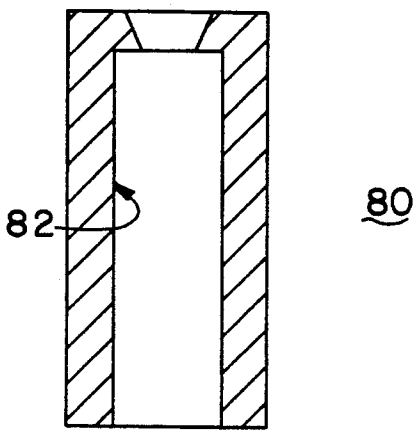
FIG. 5(A) is a fragmentary vertical cross-sectional view of a housing for use with the socket contact of FIGS. 4(A)–4(C).
Figure 5B:
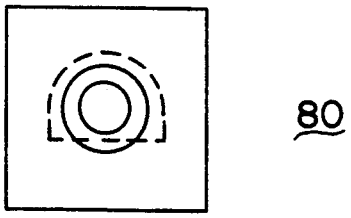
FIG. 5(B) is a top view of the housing of FIG. 5(B).
Figure 6:
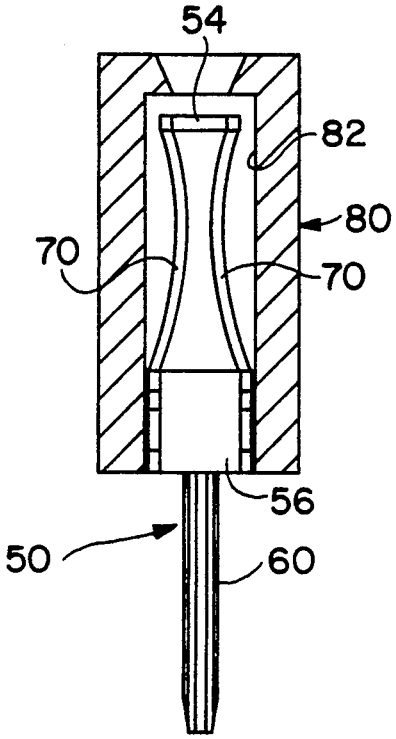
FIG. 6 is a vertical cross-sectional view of the housing of FIG. 5(A) having the socket contact of FIGS. 4(A)–4(C) therein.

FIGS. 5(A) and 5(B) show a housing 80 incorporating the socket contact 50. To receive the socket contact 50, the housing 80 includes at least a cavity 82 having an arch-shaped cross-section to accommodate the large U-shaped section 56 of the socket contact 50 whereby the barbs 59 of the large U-shaped section 56 fixedly engage the housing 80 in an interference fit so the contact portion 52 of the socket contact 50 is retained within the cavity 82 and the pin portion 60 of the socket contact 50 extends out of the housing 80, as shown in FIG. 6. The housing 80 further includes a tapered entry opening above each cavity 82 for easy insertion of the corresponding PGA lead pin.

It can be appreciated that through the small U-shaped section 54 the beams 70 are joined together as a unit to prevent torsional twist of the individual beam, and the small U-shaped section 54 is small enough to provide clearance in almost all directions with the cavity 82 of the housing 80. This allows the contact 50 to compensate partially for any misalignment of the mating lead pin on the PGA package.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

Therefore, persons of ordinary skill in this field are to understand that all such equivalent structures are to be included within the scope of the following claims:

What is claimed is:

1. An electrical socket contact comprising:

an elongated sleeve having an upper round hollow portion for receiving a clip therein and a lower pin portion for reception in a hole of a board on which a PGA socket housing is mounted;

the clip including a generally circular shaped band portion at the top, said band portion being in a form of a ring with an axial seam thereof to enhance resilience;

a pair of diametrically opposite beams extending downwardly from the band portion; and a bight portion connectively intermediating between distal ends of the beams; wherein an outer diameter of the band portion of the clip is larger than an inner diameter of the hollow portion of the sleeve so the band portion fixedly engages the sleeve in circumferentially an interference fit to retain the clip within the hollow portion of the sleeve, and the bight portion combines the beams as a unit against torsional twist of each beam with an outer diameter of the bight portion of the clip being substantially smaller than the inner diameter of the hollow portion of the sleeve thereby a sufficient clearance in all directions between the hollow portion of the sleeve and the bight portion of the clip providing the compensation of the socket contact for misalignment thereof.

2. The electrical socket contact as described in claim 1, wherein the clip is made of a one-piece metal.

3. The electrical socket contact as described in claim 1, wherein the bight portion has a generally semicircular shape so that ends of the bight portion are substantially flush with side surfaces of the corresponding beams, respectively.

4. The electrical socket contact as described in claim 3, wherein the beams converge toward each other medianly and each beam has a wider cross-section medianly thereabout.

5. A one-piece electrical socket contact for reception in a cavity of a PGA socket housing, comprising:

an upper contact portion for receiving a corresponding lead pin therein and a lower pin portion for reception in a hole of a board on which the PGA socket housing is mounted;

the upper contact portion including a small U-shaped section lying at the top, a lower large U-shaped section lying at the bottom, bottom portions of which are positioned in alignment with the pin portion, and a pair of generally parallel beams integrally intermediating therebetween, whereby the large U-shaped section fixedly engages the PGA socket housing to retain the socket contact within the cavity of the PGA socket housing and the small U-shaped section can freely move in almost all directions within the cavity of the PGA socket housing, wherein the cavity has an arch-shaped cross-section to securely accommodate the large U-shaped section therein.

6. The electrical socket contact as described in claim 5, wherein the large U-shaped section includes a pair of parallel upstanding legs and each leg has barbs at the top.

7. The electrical socket contact as described in claim 5, wherein the beams are bowed to each other with their closest points approximately at midway between the large U-shaped section and the small U-shaped section, and each U-shaped section has a pair of parallel upstanding legs and the beams are supported between the corresponding legs of the U-shaped sections with ends of the legs being substantially flush with side surfaces of the beams.

8. The electrical socket contact as described in claim 5, wherein each beam has a reduced dimension proximate the top where a juncture is formed between the small U-shaped section and the beam.

9. A clip for use with a sleeve receiving a PGA lead pin therein comprising a contractible generally circular ring with an axial seam to enhance resilience thereof at the top with a large diameter, a generally semicircular bight portion at the bottom with a small diameter, and a pair of diametrically opposite beams extending therebetween, the beams converging to each other medianly and having widened portions thereof, a seam formed axially of the ring of enhance resilience thereof, wherein side surfaces of the beams are flush with ends of the bight portion.

10. The clip as described in claim 9, wherein the clip is made of a one-piece metal.

* * * * *